US005381484A

United States Patent [19]

Claes et al.

[11] Patent Number: 5,381,484

[45] Date of Patent: Jan. 10, 1995

[54] HEARING AID WITH PULL-OUT-STRING, PULL-OUT STRING, AND METHOD OF MAKING A HEARING AID

[75] Inventors: Rudi A. M. Claes; Petrus A. W. H. Van Vroenhoven, both of Eindhoven, Netherlands

[73] Assignee: U.S. Philips Corporation, New York, N.Y.

[21] Appl. No.: 959,894

[22] Filed: Oct. 13, 1992

[30] Foreign Application Priority Data

Oct. 16, 1991 [EP] European Pat. Off. ..... 91202691.1

[51] Int. Cl.[6] ..... H04R 25/00

[52] U.S. Cl. ..... 381/68.6; 381/68; 381/23.1

[58] Field of Search ..... 381/68.6, 68.5, 68, 381/72, 23.1, 183, 187; 455/269, 349, 351; 289/18.1

[56] References Cited

U.S. PATENT DOCUMENTS 3,890,474 6/1975 Glicksberg ..... 381/72

4,836,587 6/1989 Hinzmann ..... 289/18.1

*Primary Examiner*—Curtis Kuntz

*Assistant Examiner*—S. Tran

*Attorney, Agent, or Firm*—Bernard Franzblau

[57] ABSTRACT

A pull-out string for connection to a hearing aid which is constructed for use in an ear canal near a tympanic membrane. The pull out string has two ends and a fixing element at each end for connection to the hearing aid. The pull-out string has a plurality of beads, the distance from each bead to an end of the pull-out string being unique. In a method of manufacturing a hearing aid provided with such a pull-out string, the pull-out string is secured to the hearing aid at one end and is severed at a desired distance from the hearing aid such that the pull-out string has a bead at the resulting free end. This results in a hearing aid having a pull-out string whose length can be chosen from many possible values and whose free end can be gripped satisfactorily.

19 Claims, 1 Drawing Sheet

HEARING AID WITH PULL-OUT-STRING, PULL-OUT STRING, AND METHOD OF MAKING A HEARING AID

BACKGROUND OF THE INVENTION

This invention relates to a pull-out string for connection to a hearing aid constructed for use in an ear canal near a tympanic membrane, which pull-out string has a first and a second end and fixing means for connection to the hearing aid.

The invention also relates to a method of manufacturing a hearing aid provided with a pull-out string, which hearing aid is adapted for use in an ear canal near a tympanic membrane and comprises a housing having a first side, which should face forward when the hearing aid is inserted into the ear canal, and a second side, to which the pull-out string is secured to pull the hearing aid out of the ear canal.

The invention further relates to a heating aid which can be manufactured by means of the method, which hearing aid comprises a pull-out string.

A pull-out string of the type defined in the opening paragraph having fixing means for connection to a hearing aid to pull the heating aid out of an ear canal and a hearing aid of the type defined above are known from FR 2,634,645 A1. Hearing aids inserted deep into the ear canal are difficult to remove. The customary method of removing hearing aids from the ear canal by moving the auricle to release the hearing aid from its clamped-in position in the ear canal does not work if the hearing aid has ben inserted deep into the ear canal, because the part of the ear canal near the tympanic membrane consists of bony tissue, which is undeformable. To enable a hearing aid which has been inserted deep into the ear canal to be removed from the ear canal pull-out strings are attached to these hearing aids. These pull-out strings should provide such a firm hold that they can be pulled adequately. For this purpose the pull-out string should extend well into the auricle.

SUMMARY OF THE INVENTION

It is an object of the invention to provide a pull-out string of the type defined in the opening paragraph which can be held more effectively and which is shorter. To this end the pull-out string in accordance with the invention is characterised in that both ends are provided with fixing means and the pull-out string comprises a plurality of beads, the distance from each bead to an end of the pull-out string being unique or different. By fastening one end of this pull-out string to the hearing aid and cutting the pull-out string to length behind a bead a hearing aid is obtained having a pull-out string of the appropriate length with a bead at its free end. The presence of a bead at the free end provides a better grip on the pull-out string and, in addition, the pull-out string can be shorter because only the bead needs to be held. Apart from a better grip, this pull-out string has the advantage that the string is less conspicuous when the hearing aid is in the ear canal because the pull-out string is shorter. Since the distance from each bead to one end of the pull-out string is unique many different lengths of the pull-out string with a bead at the end can be realised.

An embodiment of the pull-out string in accordance with the invention is characterised in that the distance between a first end and the bead nearest the first end is a and the distance between a second end and the bead nearest the second end is b, a being unequal to b, and the distances between two successive beads being 2.(a−b), all the distances between two successive beads being equal. If this is complied with the pull-out string can be cut at one end in such a way that the length of the residual part of the pull-out string can be selected to equal:

$$a+c(a-b),$$

where c is a positive integer which at the most is equal to the number of beads minus one. With a minimum of beads it is thus possible to be obtain a pull-out string having a length which can be selected from a series of uniformly increasing values.

A further embodiment of the pull-out string in accordance with the invention is characterised in that a is 9 mm and b is 11 mm. This enables the length of the pull-out string to be selected from a series starting from 9 mm with 2 mm increments.

Another embodiment of the pull-out string in accordance with the invention is characterised in that the distance between the first end and the bead nearest the first end is a and the distance between the second end and the bead nearest the second end is b, a being unequal to b, and the distances between two successive beads near an end is d and the other distances between two successive beads is e, where $$e=nd,$$

$$b=a+md,$$

n and m being positive integers. This also enables the length of the pull-out string to be selected from a series of uniformly increasing values and, moreover, the distance from the end by which the pull-out string is secured to the hearing aid to the nearest bead can be selected from two values whose difference is larger than in the case of the preceding embodiments. This is an advantage because it is desirable that the bead nearest the hearing aid be situated as close as possible to the auricle in view of the greater sensitivity of the more inward part of the ear canal.

In a further embodiment of the pull-out string in accordance with the invention, a is 9 mm, b is 15 mm, d is 2 mm, and e is 4 mm. However, it is now also possible to select 9 or 15 mm for the distance between the hearing aid and the bead nearest the hearing aid. This is in contrast to from the preceding embodiment, in which the only choice was 9 or 11 mm.

Yet another embodiment of the pull-out string in accordance with the invention is characterised in that the pull-out string is made of nylon and has a thickness of at least substantially 0.3 ram, and the beads and fixing means are also made of nylon and are integral with the pull-out string. Such a pull-out string can be manufactured simply and is so stiff that the pull-out string cannot slide deep into the ear canal, so that it can always be gripped without any tools.

The method in accordance with the invention is characterised in that the pull-out string is severed at a desired distance y from the hearing aid such that $$y=a+nd$$

and the pull-out string has a bead at the resulting free end. Thus, the hearing aid can be provided with a pull-out string and inserted into the ear canal of a user, after which the pull-out string is cut to length.

The heating aid in accordance with the invention is characterised in that the pull-out string has a bead at least at its free end. The presence of a bead provides a better grip on the pull-out string, which also enables a shorter pull-out string to be used because only the bead has to be gripped. Apart from a better grip this pull-out string has the advantage that the string is less conspicuous when the hearing aid is in the ear canal, because the pull-out string is shorter.

BRIEF DESCRIPTION OF THE DRAWINGS

The invention will now be described in more detail, by way of example, with reference to the accompanying drawing. In the drawing.

DESCRIPTION OF THE PREFERRED EMBODIMENTS

Figure 1:
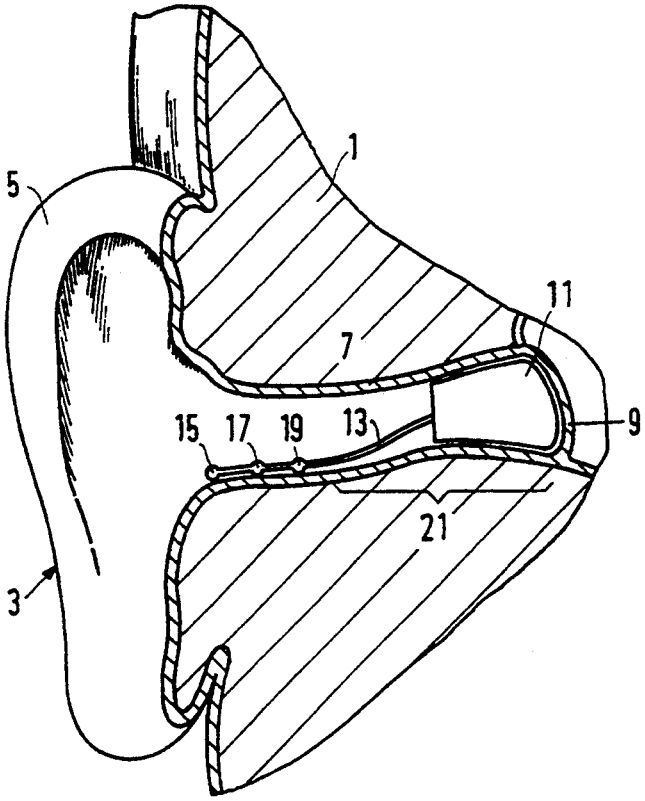
FIG. 1 is a sectional view of a head at the location of an ear with a hearing aid having a pull-out string.

FIG. 1 is a sectional view of a head 1 at the location of an ear 3. The ear 3 has an auricle 5 and an ear canal 7 with a tympanic membrane 9. In the ear canal a hearing aid 11 is situated against the tympanic membrane. In order to enable the hearing aid 11, which has been inserted deep into the ear canal 7, to be removed from the ear a pull-out string 13 has been secured to the hearing aid. To provide a firm grip on the free end of the pull-out string 13 the pull-out string is provided with a bead 15 at this end. Moreover, the pull-out string 13 comprises several further beads 17, 19 to enable the pull-out string 13 to be cut to length in such a way that the new end also has a bead. It is desirable that no beads be situated in the deeper part 21 of the ear canal 7 in view of the greater sensitivity of the more inward part 21 of the ear canal 7. Therefore, it is advantageous if the bead 19 nearest the hearing aid be situated as close as possible to the auricle 5.

Figure 2:
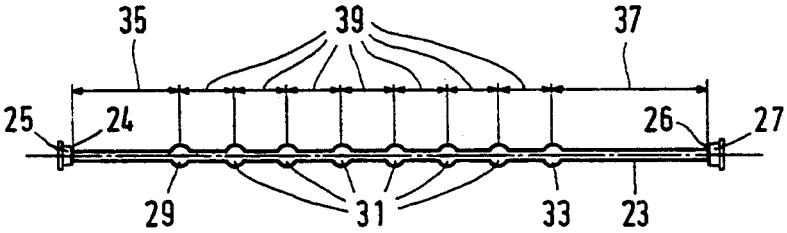
FIG. 2 shows a first embodiment of the pull-out string in accordance with the invention.

As the lengths of the ear canals of the persons wearing a hearing aid differ, it is advantageous if the pull-out strings are available in different lengths. In order to avoid that a separate pull-out string has to be manufactured for every desired length, a pull-out string 23 has been designed (see FIG. 2) provided with fixing means 25, 27 at both ends 24, 26 and comprising a plurality of beads 29, 31, 33, the distance 35 from each bead 29, 31, 33 to an end 24, 26 of the pull-out string 23 being unique. By fastening this pull-out string 23 to the hearing aid 11 at one end 24, 26 and cutting the pull-out string to the appropriate length behind a bead a hearing aid is obtained having a pull-out string of the desired length with a bead at the free end.

The distance 35 between the first end 24 and the bead 29 nearest the first end 24 is 9 mm and the distance 37 between the second end 26 and the bead 33 nearest the second end 26 is 11 mm. The distances 39 between two successive beads 29, 31, 33 is 4 mm, all the distances 39 between two successive beads being equal. The pull-out string 23 can be cut at one end, while the length of the useful pan of the pull-out string can be selected from a series of distances from 9 to 39 mm with 2 mm increments, depending on which end 24, 26 is chosen.

Figure 3:
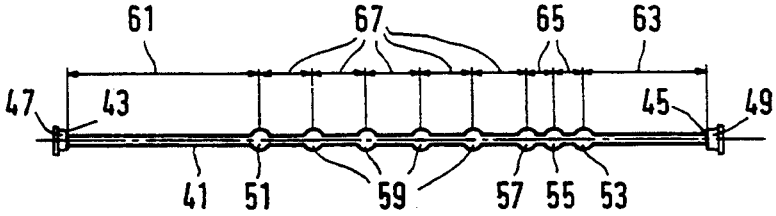
FIG. 3 shows a second embodiment of the pull-out string in accordance with the invention.

In another embodiment of the pull-out string 13 in accordance with the invention (see FIG. 3) the distance 63 between the first end 45 and the bead 53 nearest the first end 45 is 9 mm and the distance 61 between the second end 43 and the bead nearest the second end 43 is 15 mm. Furthermore, the distances 65 between successive beads 53, 55, 57 near the first end 45 are 2 mm and the other distances 67 between two successive beads 51, 57, 59 are 4 mm. Thus, the space between first and second beads 55 and 57, respectively, is different from the space between the second and third beads, 57 and 59 respectively. This embodiment also enables the length of the pull-out string to be selected from a series of lengths increasing with 2 mm increments and starting with 9 mm. However, it is now also possible to choose whether the distance 61, 63 between the hearing aid and the bead 51, 53 nearest the hearing aid is 9 mm or 15 mm.

The pull-out string is made of nylon and has a thickness of 0.3 mm, the beads 51, 53, 55, 57, 59 and the fixing means 47, 49 also being made of nylon and being integral with the pull-out string 41. Such a pull-out string can be manufactured simply and has a stiffness such that the pull-out string cannot slide deep into the ear canal, so that it can always be gripped without the use of any tools.

To adjust the length of the pull-out string 41 (see FIG. 4) the hearing aid 71 is provided with the pull-out string and is inserted into the ear canal 7 of a person. The hearing aid 71 has a housing 73 having a first side 75, which should face forward when the hearing aid 71 is inserted into the ear canal 7, and a second side 77, to which the pull-out string 41 is secured. Subsequently, the appropriate length of the pull-out string 71 is determined and the pull-out string is severed at a desired distance 69 from the hearing aid 71, a bead 59*a* being situated at the free end 70 of the pull-out string 41.

Figure 4:
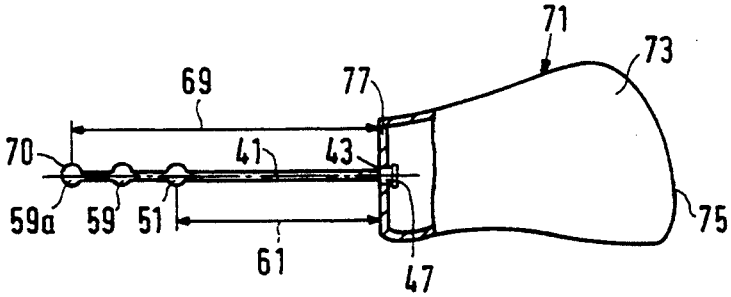
FIG. 4 shows a hearing aid provided with a pull-out string and manufactured by means of the method in accordance with the invention.

FIG. 4 shows a hearing aid 71 thus obtained and provided with a pull-out string 41 which has been cut to length, the distance 61 between the hearing aid 71 and the nearest bead 51 being 15 mm.

Although the invention has been described above with reference to the drawing it is to be noted that the invention is not limited to the embodiments shown in the drawing. The invention also extends to all embodiments which deviate from those shown in the drawings but are within the scope of the claims and which utilise the basic idea of the invention. For example, in contrast to what is shown in the drawing, it is possible to use a pull-out string with different distances between two successive beads.

We claim:

1. A pull-out string for connection to a hearing aid constructed for use in an ear canal near a tympanic membrane, said pull-out string comprising: a first end and a second end wherein both ends are provided with fixing means for connection to the hearing aid and the pull-out string comprises a plurality of beads, the distance from each bead to an end of the pull-out string being different.

2. The pull-out string as claimed in claim 1, wherein the distance between the first end and the bead nearest the first end is a and the distance between the second end and the bead nearest the second end is b, a being unequal to b, and the distances between two successive beads being 2(a−b), all the distances between two successive beads being equal.

3. The pull-out string as claimed in claim 2, wherein a is 9 mm and b is 11 mm.

4. The pull-out string as claimed in claim 2, wherein the pull-out string is made of nylon and has a thickness of at least 0.3 mm, and the beads and the fixing means are also made of nylon and are integral with the pull-out string.

5. The pull-out string as claimed in claim 1, wherein the distance between the first end and the bead nearest the first end is a and the distance between the second end and the bead nearest the second end is b, a being unequal to b, and the distances between two successive beads near an end is d and the other distances between two successive beads is e, where $$e=nd,$$

$$b=a+md,$$

n and m being positive integers.

6. The pull-out string as claimed in claim 5, wherein a is 9 mm, b is 15 mm, d is 2 mm, and e is 4 mm.

7. The pull-out string as claimed in claim 5, wherein the pull-out string is made of nylon and has a thickness of at least 0.3 mm, and the beads and the fixing means are also made of nylon and are integral with the pull-out string.

8. A pull-out string as claimed in claim 1, wherein the pull-out string is made of nylon and has a thickness of at least 0.3 mm, and the beads and the fixing means are also made of nylon and are integral with the pull-out string.

9. The pull-out string as claimed in claim 1 wherein the plurality of beads are located on the pull-out string so that the pull-out string can be cut into any one of a plurality of different lengths in successive increments of length which increase in succession with equal increments and wherein the spacings between successive beads is greater than said equal increments.

10. The pull-out string as claimed in claim 9 wherein the increments of length are 2 mm and the spacings between successive beads are 4 mm.

11. A method of manufacturing a hearing aid adapted for use in an ear canal near a tympanic membrane and where the hearing aid comprises a housing having a first side, where said first side faces forward when the hearing aid is inserted into the ear canal, and a second side, said method comprising: securing a pull-out string having a plurality of beads to said second side of the housing to pull the hearing aid out of the ear canal, and severing the pull-out string at a desired distance y from the hearing aid such that $$y=a+n(d)$$

wherein a is the distance from said second side of the hearing aid to a bead closest to said second side, d is the distance between adjacent beads, n is an integer determined by the number of beads, and the pull-out string has a bead at a resulting free end.

12. The method as claimed in claim 11 wherein, prior to securing and severing the pull-out string, the method further comprises:

providing the pull-out string with a securing means at each end thereof and with said plurality of beads, wherein the distance from each bead to an end of the pull-out string is different.

13. The method as claimed in claim 12 wherein the plurality of beads of the pull-out string is provided with at least first, second and third successive beads and with the beads positioned such that the distance between a first end and a bead nearest the first end is a and the distance between a second end and a bead nearest the second end is b, a being unequal to b, and the distances between two successive beads being 2 (a−b), and the distances between at least the first and second and the second and third successive beads being equal.

14. The method as claimed in claim 12 wherein the plurality of beads of said pull-out string are positioned such that the distance between a first end and a bead nearest the first end is a, and the distance between a second end and a bead nearest the second end is b, a being unequal to b, and the distances between two successive beads near one end of the string is d and the other distances between two successive beads is e, where e=nd; and b=a+md, where n and m are positive integers.

15. A hearing aid adapted for use in an ear canal near a tympanic membrane and comprising:

a housing having a first side adapted to be mounted adjacent the tympanic membrane, and a second opposite side adapted to face the entrance to the ear canal, means contained within said housing for converting and amplifying received sound energy, and a pull-out string having one end secured to the second side of the housing and said pull-out string includes a plurality of beads and with an end bead at a free end of the pull-out string located at a desired distance Y from the second side of the hearing aid such that Y=a+n(d), where a is the distance from the second side of the hearing aid to a bead closest to said second side, d is the distance between adjacent beads, and n is an integer determined by the number of beads.

16. The hearing aid as claimed in claim 15 wherein the pull-out string is made of nylon and includes at said one end means for securing the pull-out string to the second side of the housing, and wherein the plurality of beads and the means for securing are also made of nylon and are integral with the pull-out string.

17. The hearing aid as claimed in claim 15 wherein the plurality of beads includes at least first, second and third beads with a space between the first and second beads being different from space between the second and third beads.

18. A pull-out string for connection to a hearing aid adapted to be inserted into an ear canal and close to a tympanic membrane, said pull-out string comprising:

a first end and a second end with a plurality of spaced-apart beads therebetween, each end of the pull-out string having a means for securing the pull-out string to the hearing aid, and wherein the distance of each bead to either end of the pull-out string is different, the distance between the first end and a bead closest to the first end being different from the distance between the second end and a bead closest to the second end.

19. The pull-out string as claimed in claim 18 wherein the plurality of spaced apart beads comprises at least three successive beads having equal distances therebetween.

* * * * *